US008161681B2

(12) United States Patent
Treihaft

(10) Patent No.: US 8,161,681 B2
(45) Date of Patent: Apr. 24, 2012

(54) RELEASABLE ARM ASSEMBLY FOR A SWING GATE

(76) Inventor: Michael T. Treihaft, Powell Butte, OR (US)

( * ) Notice: Subject to any disclaimer, the term of this patent is extended or adjusted under 35 U.S.C. 154(b) by 850 days.

(21) Appl. No.: 12/165,038

(22) Filed: Jun. 30, 2008

(65) Prior Publication Data

US 2009/0320375 A1 Dec. 31, 2009

(51) Int. Cl.
*E01F 13/00* (2006.01)

(52) U.S. Cl. ..... 49/49; 49/9; 49/141

(58) Field of Classification Search ..... 49/9, 49, 49/141; 404/10
See application file for complete search history.

(56) References Cited

U.S. PATENT DOCUMENTS

| | | | | |
|---|---|---|---|---|
| 4,364,200 | A * | 12/1982 | Cobb | 49/192 |
| 4,897,960 | A * | 2/1990 | Barvinek et al. | 49/49 |
| 4,916,860 | A | 4/1990 | Richmond et al. | |
| 5,076,012 | A | 12/1991 | Richmond et al. | |
| 5,230,179 | A | 7/1993 | Richmond et al. | |
| 5,752,344 | A | 5/1998 | Richmond | |
| 5,804,938 | A | 9/1998 | Richmond et al. | |
| 5,873,200 | A * | 2/1999 | Henderson | 49/343 |
| 5,918,418 | A | 7/1999 | Richmond et al. | |
| 5,942,867 | A | 8/1999 | Richmond | |
| 5,992,800 | A * | 11/1999 | Sass | 246/127 |
| 6,470,626 | B2 * | 10/2002 | Luetzow et al. | 49/9 |
| 6,672,008 | B1 * | 1/2004 | Luetzow et al. | 49/9 |
| 6,813,860 | B2 * | 11/2004 | Burnette et al. | 49/49 |
| 6,966,146 | B2 * | 11/2005 | Pease | 49/49 |
| 7,814,706 | B2 * | 10/2010 | Gamache | 49/49 |
| 7,818,920 | B2 * | 10/2010 | Causey et al. | 49/49 |
| 2006/0228177 | A1 * | 10/2006 | Allain et al. | 404/6 |
| 2011/0113690 | A1 * | 5/2011 | Luetzow et al. | 49/49 |

FOREIGN PATENT DOCUMENTS

EP 584049 A1 * 2/1994

* cited by examiner

*Primary Examiner* — Jerry Redman
(74) *Attorney, Agent, or Firm* — Hancock Hughey LLP

(57) ABSTRACT

A gate arm for a swing gate incorporates a release mechanism that releases the gate arm and therefore allows the gate to swing freely about its hinges when inwardly-directed pressure applied to the gate exceeds a threshold level. The gate arm also includes a spring-loaded pivot joint that applies pressure to the gate when the gate is operating normally and is in the closed position, and further works cooperatively with the release mechanism to prevent damage to the operator and gate arm when the gate is forced open.

20 Claims, 7 Drawing Sheets

RELEASABLE ARM ASSEMBLY FOR A SWING GATE

FIELD OF THE INVENTION

This invention relates to mechanisms used to operate automate gates, and more particularly, to a swing arm for use with an automatic gate that includes a release mechanism that releases the gate in the event that pressure is applied to the gate and thus allows the gate to swing open to prevent damage, and also a sprung pivot joint that works cooperatively with the release mechanism. The invention provides an apparatus and method for releasing a gate in the event the gate needs to be opened in, for instance, an emergency situation.

BACKGROUND

Automatically operated swing gates are used in many settings, from industrial to residential applications. Such gates are used for many different reasons, including both security and to provide an attractive finish to a property. While there are many different styles and kinds of swing gates, and while these kinds of gates may be sold under many different names, most share certain characteristics, namely, a gate that is hinged on one side, an operator that drives the gate from the closed to the open position and back again, and a gate arm that interconnects the operator to the gate. Most automatic swing gates also include a user interface that allows for operation of the gate. Typically user interfaces include key pads positioned next to the gate on the outer side of the fencing, and sensing units such as RF sending units that open the gate automatically when the sending unit is in proximity to the sensing unit on the operator.

While the popularity of automatic swing gates has increased rapidly in recent years, there are several known security issues with the gates. For example, if fire or rescue personnel are called to a residence that has an automatic gate that is closed, the gate may slow the response time for getting to the residence. Even if the gate is operating normally, in an emergency situation, individuals in the residence who need assistance may not have the presence of mind to open the gate to allow the emergency responders into the property.

A similar problem exists when there is a power outage and emergency crews need to get through a gate. If the gate operator does not have emergency power backup such as a battery, emergency crews may not be able to get the gate to open even if they know the entry code.

As a result of these and other problems, it is relatively common for emergency responders to use a truck or other vehicle to push the gate from the outside. When balancing the need to provide emergency services against the possible damage to a broken gate, the needs of the emergency service providers usually outweighs the cost of damage to the gate. Unfortunately, automatic swing gates are sometimes pushed open by vehicles driven by individuals with more nefarious purposes: criminals are known to push gates open in order to gain entry to an otherwise restricted area.

Regardless of the reasons why a swing gate might be pushed open forcefully rather than using the operator to open the gate normally, the undesired inward pressure on the gate often causes serious damage. Swing gates have a gate arm that interconnects the operator—that is, the motor and associated components that drive the gate—to the gate. The gate arm may be jointed or linear, but in either case, when the gate is in the closed position the gate arm is fully extended so that there is some pressure applied to the gate to keep it in the closed position. When pressure is applied to the gate to push it open (i.e., without using the operator to open the gate), pressure is applied directly to the gate arm, and through the gate arm to the operator. Because the gate arm is linear, the pressure is transmitted directly to the components in the operator, such as the drive shaft that connects the operator's motor to the gate arm. When the pressure exceeds the strength of the gate, something gives way, and that typically is either the gate arm or the operator, or both. This results in serious damage to the gate system, which may be very expensive to repair. Moreover, once the gate arm and/or operator are damaged, the gate cannot be closed, at least not automatically, until repairs have been made.

There is a need therefore for an improved and more robust gate arm system for an automatic swing gate.

The present invention relates to a gate arm that incorporates a release mechanism that releases the gate and allows the gate to swing freely about its hinges when inwardly-directed pressure applied to the gate exceeds a threshold level. The gate arm also includes a pivot joint that is sprung, and which therefore applies pressure to the gate when the gate is operating normally and is in the closed position, and further works cooperatively with the release mechanism to prevent damage to the operator and gate arm when the gate is forced open. The sprung pivot joint further causes the gate arm to initiate its pivotal movement, and also holds the gate arm in the correct position so that when the operator is operated, the release mechanism will relatch.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

Figures 1, 2:
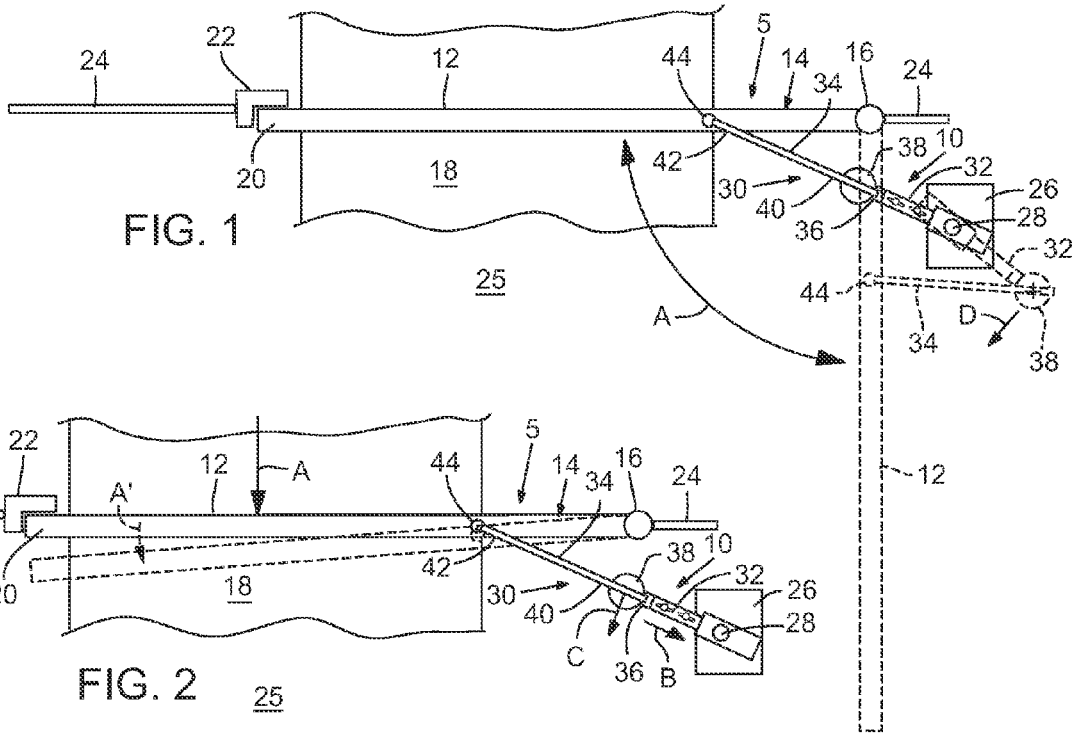
FIG. 1 is a top view of a swing gate incorporating a gate arm and pivot joint according to the present invention, illustrating the gate and arm components in the closed position in solid lines and in the open position in dashed lines.
FIG. 2 is a top view similar to FIG. 1, showing the forces that are applied to the gate and the gate arm when the gate is pushed from the closed position toward the open position.

A swing gate assembly 5 that incorporates the components of the present invention is illustrated in FIG. 1. Each separate component will be described in detail below, but to provide context, the gate assembly will be described generally. The gate assembly 5 comprises a gate 12 that is hinged on a proximate end 14 to an appropriate stanchion such as a vertical post 16 that has been anchored in the ground so that the gate 12 swings over a driveway 18, as illustrated with arrow A between the closed position (shown in solid lines) and the open position (shown in dashed lines). When gate 12 is in the closed position, the distal end 20 of the gate typically latches to another vertical stanchion such as post 22. Fencing 24 connects to post 22 and typically defines an enclosed area, referred to generally with reference number 25, but not shown in its entirety. At times herein, relative directional terms are used to identify certain structures, their location and their operation. These directional terms rely upon the ground plane as an initial point of reference. Thus, the word "upwardly" refers to the direction vertically upward from the ground. "Downwardly" is the opposite direction. The word "inwardly" refers to the direction that lies within an enclosure defined by gate 12 and fencing 24—the gate 12 thus swings "inwardly" as it moves from the closed position toward the open position, and swings "outwardly" in the opposite direction. "Outside" refers to the area external of the enclosure 25; "inside" refers to the area of the enclosure 25 internally of the fence and gate.

Gate assembly 5 further includes an operator 26, which is a conventional motor unit, typically electric, that functions to drive the gate between open and closed positions. There are many different kinds of operator units that are commercially available and appropriate for use with the gate assembly 5 described herein. The operator 26 shown in the figures includes a vertically oriented drive shaft 28 that is fixed to the gate arm, as detailed below. The operator includes a motor that rotates drive shaft 28 in both rotational directions, and the gate assembly 5 includes a control system (not shown) that defines an interface for controlling the gate assembly 5 by the user. There are many kinds of control systems, but one typical control system includes a key pad located on the outside of the enclosure 25 in proximity to driveway 18 so that the driver of a car may operate the key pad without exiting the car. A "loop detector" sensor is typically located inside the enclosure that senses a car exiting the enclosure 25 and causes the gate 12 to open automatically when an exiting car is detected, although again, there are many different kinds of control systems available.

Gate arm 10 is shown generally in FIG. 1 and serves to interconnect the gate 12 with the operator 26. The gate arm and its component parts are described in detail below, and comprises a two part elongate shaft 30 that is defined by a pair of arms that are interconnected by a pivoting joint. Thus, the first or proximate gate arm section 32 and second or distal gate arm portion 34 are each connected to the pivot joint. More specifically, the outer end 36 of gate arm 32 is attached to a pivot joint 38, and the inner end 40 of gate arm 34 is likewise attached to the pivot joint 38. The outer end 42 of gate arm 34 is pivotally attached to gate 12 at a hinge 44. Drive shaft 28 is fixedly attached to gate arm 10 at a release mechanism 46, which is described in detail below.

Figure 3:
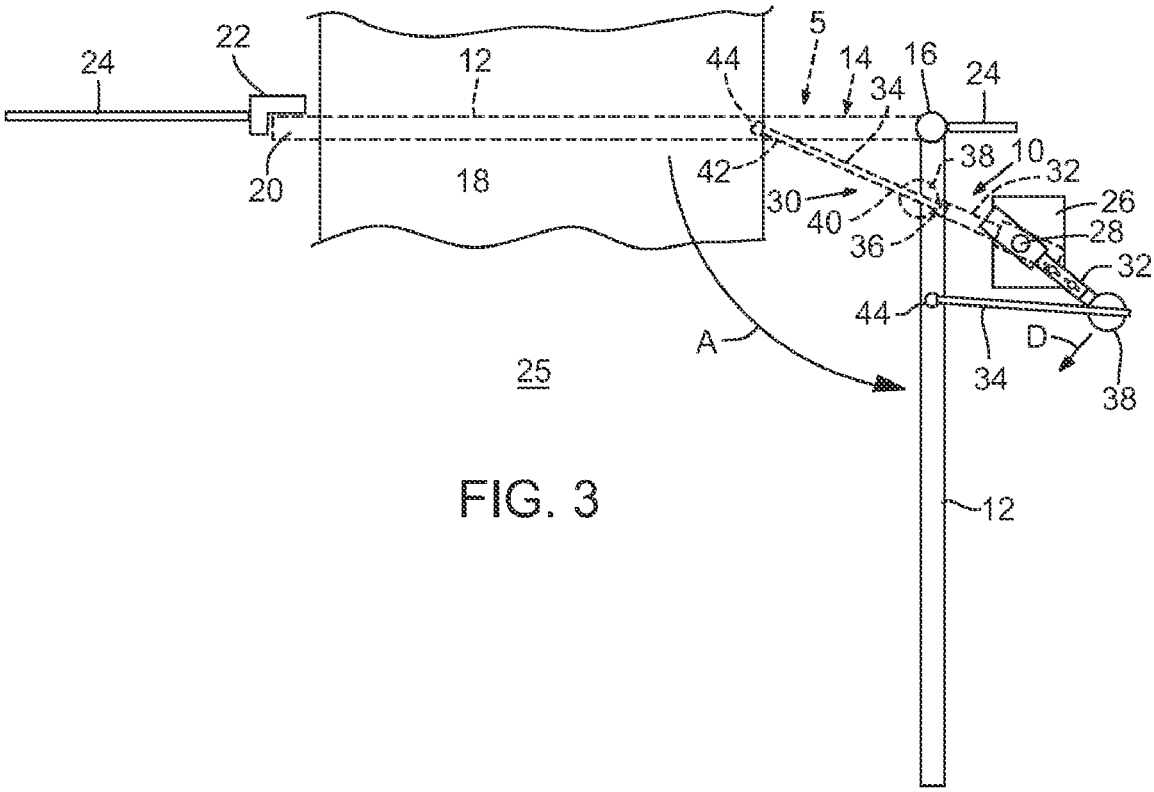
FIG. 3 is a top view similar to FIG. 1 showing the gate in the fully open position after the release mechanism according to the present invention has been activated after pressure has been applied to the gate.

Operation of gate assembly 5 will be described briefly with reference to FIGS. 1, 2 and 3. Normal operation of the gate assembly is shown in FIGS. 1 and 3. When in the closed position, the distal end 20 of gate 12 abuts post 22, and if the post and gate are fitted with a latch, is latched to the post. In this position the gate arm 10 is linear—that is, shaft 30 is straight with both proximate and distal gate arms 32 and 34, respectively, axially aligned. Ideally, in this position the gate arms apply force against gate 12 so that the gate is not prone to wobbling and is instead tightly closed. With reference now to FIG. 3, gate 12 is shown in the fully open position (this position is also shown in FIG. 1 with dashed lines). To get to this open position from the closed position, drive shaft 28 has rotated in the counter clockwise direction (in the view of FIG. 3) approximately 180°. As the drive shaft rotates, it rotates the proximate gate arm 32. Recall that the distal end 42 of gate arm 34 is hinged to gate 12 at a hinge 44. Thus, as drive shaft 28 rotates, pivot joint 38 allows shaft 30 to pivot at the pivot joint. This pulls gate 12 toward the open position as shown in FIG. 3 with arrows A and B. In the fully open position, drive shaft 28 maintains rotational pressure on the gate arm 30 so that the gate remains firmly in the open position. Under normal operating conditions, the gate 12 will swing back and forth between open and closed for many, many cycles.

An abnormal condition is illustrated in FIG. 2. Here, arrow A indicates undesired force being applied to gate 12 forcing the gate from the closed position toward the open position, without rotation of drive shaft 28, forcing the gate open as shown with A'. This kind of force occurs, for example, when a car or an emergency vehicle pushes against the gate without activating the normal opening mechanisms. When this happens, force is applied to gate arm 10 in the direction illustrated with arrow B—that is, linearly down the elongate shaft 30. Normally, if the gate were opening under the control of operator 26 and drive shaft 28 were thus rotating, shaft 30 would bend at pivot joint 38 (arrow C). However, because operator 26 is not functioning and drive shaft 28 is therefore not rotating, force applied in the direction of arrow B can result in severe damage to the entire gate assembly 5, including for example, bent gate arms 10, bent drive shafts 28, and other broken components. This kind of damage is unfortunately all-too-common. The release mechanism of the present invention eliminates this kind of damage.

Figure 4:
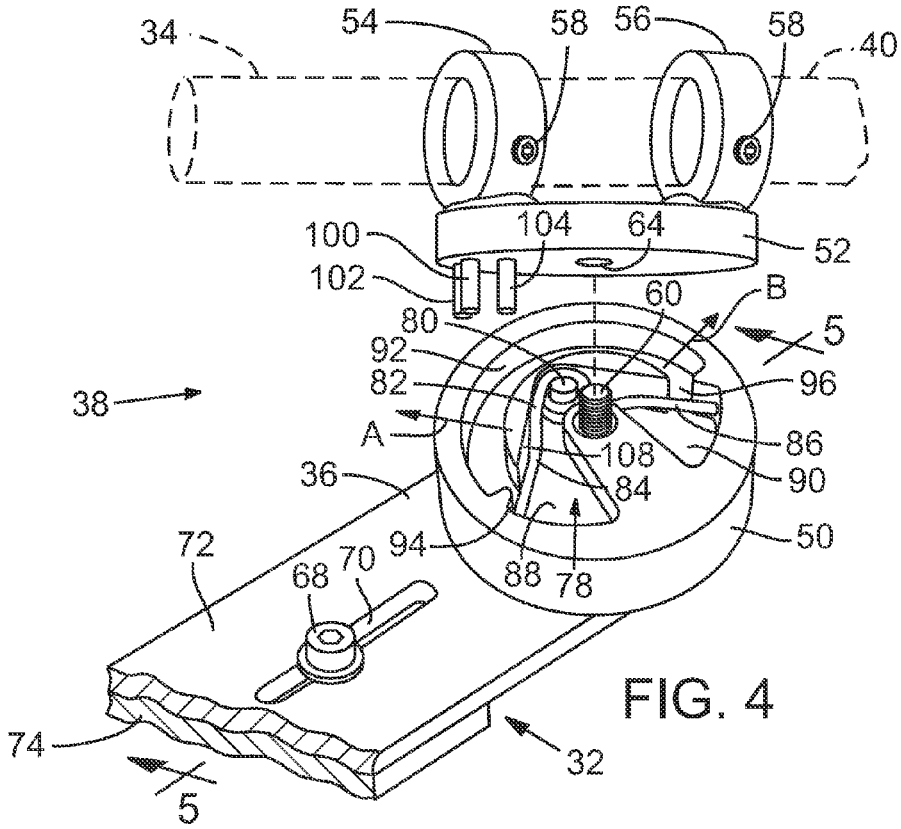
FIG. 4 is an isolated and exploded view of the pivot joint according to the present invention.
Figure 5:
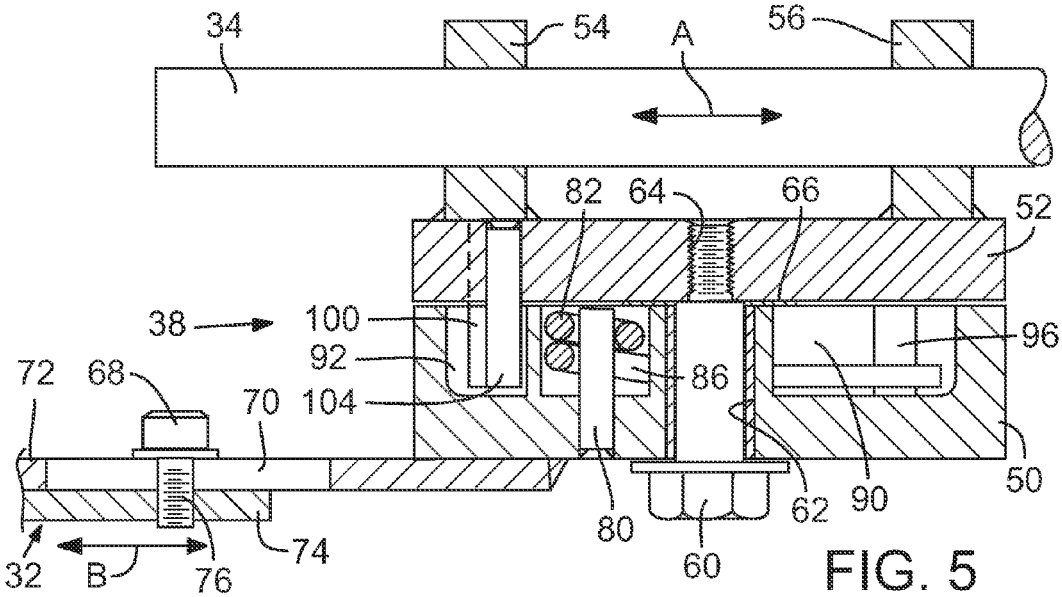
FIG. 5 is a schematic cross sectional view of the pivot joint taken along the line 6-6 of FIG. 5.
Figure 6:
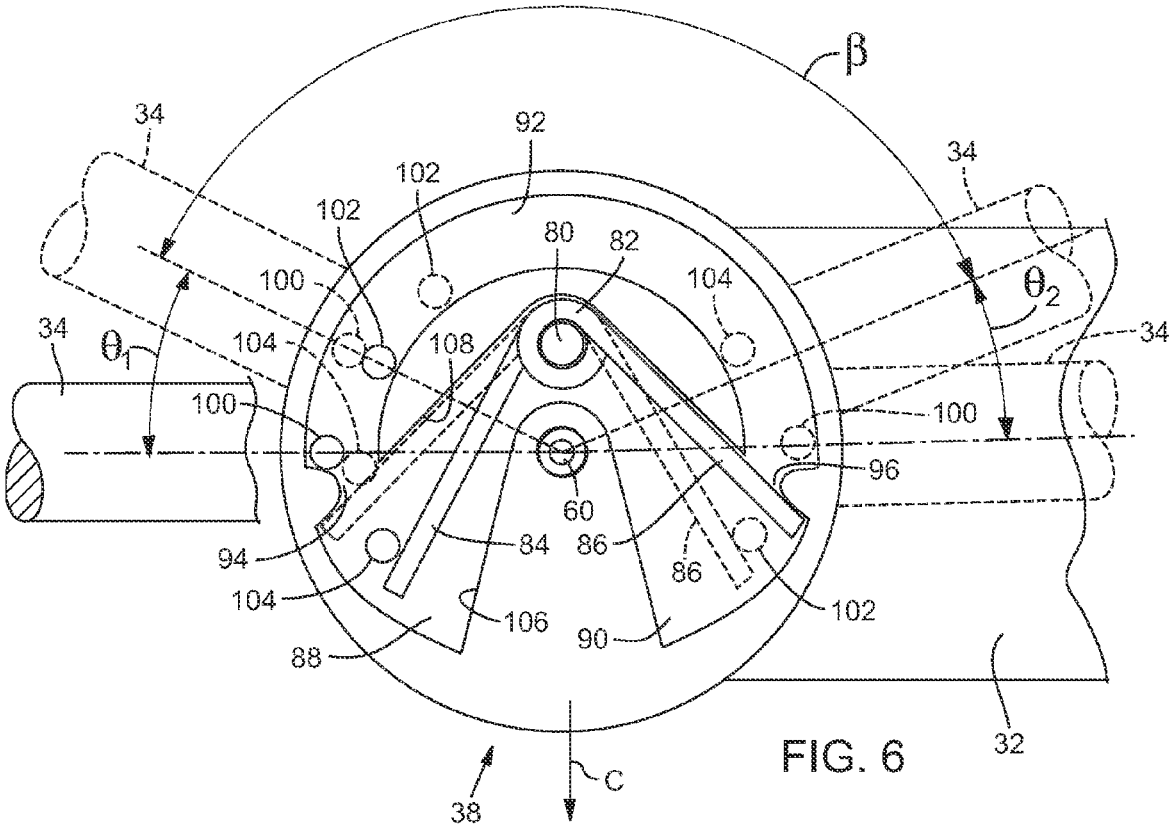
FIG. 6 is a view of the pivot joint illustrating the internal components of the pivot joint and showing the associated gate arms and the movements that the pivot joint goes through as the gate swings between open and closed positions.

Reference is now made to FIGS. 4 through 6, which illustrate the pivot joint 38 according to the illustrated embodiment of the invention. As indicated earlier, the pivot joint 38 interconnects the two arms that define the elongate shaft 30, namely, proximate gate arm 32 and distal gate arm 34. The pivot joint interconnects these two shaft portions and allows the combined elongate shaft 30 to flex as the gate 12 moves between open and closed positions. As detailed below, the pivot joint is sprung, which provides further structural and operational benefits.

Pivot joint 38 comprises a housing defined by a lower or first body portion 50 affixed to the outer end 36 of gate arm 32, and an upper or second body portion 52 to which gate arm 34 is attached. In a preferred embodiment, gate arm 34 is adjustably attached to second body portion 52. In the figures, gate arm 34 is shown as a cylindrical rod, and the rod is received in a pair of eyes 54 and 56, each of which is fitted with a set screw 58. It will be appreciated that the overall length of elongate shaft 30 may be easily adjusted by adjusting the position at which shaft 34 is fixed to the two eyes 54 and 56. It will also be readily appreciated that the configuration of the arms 32 and 34 may be varied widely from those shown in the illustrated embodiments. For example, the arm 34 could be square in cross section and the arm 32 could be a cylindrical rod; both arms 32 and 34 could just as easily be square shafts.

The first body portion 50 may be welded to arm 32 or attached in any convenient manner, for example with bolts. The second body portion 52 is rotatably attached to the first body portion 50 with a bolt 60 that extends through a bore 62 in body portion 50 and threads into a threaded bore 64 in body portion 52. As best seen in FIG. 5, which is a schematic cross sectional view, when the two body portions 50 and 52 are attached to one another with bolt 60, the two body portions may be axially rotated relative to one another about the axis defined by bolt 60. A spacer or washer 66 may be placed around bolt 60 between the two body portions. As noted above, the overall length of elongate shaft 30 may be increased or decreased by adjustment of the point of attachment between shaft 34 and eyes 54 and 56—this is illustrated with arrow A in FIG. 5. It may be seen that the length of shaft 32 is likewise adjustable. In the illustrated embodiments, gate arm 32 is defined by an upper elongate plate 72 and a lower elongate plate 74. These two plates may be slid relative to one another to increase the overall length of the gate arm 32. This adjustability is provided with bolt 68 that extends through a longitudinal slot 70 in an upper elongate plate 72 and which threads into a threaded bore 76 in lower elongate plate 74. With returning reference to FIG. 1, it may be seen that gate arm 32 includes a pair of adjustment structures such as that just described so that the length of the shaft may be widely adjusted and so that the arm is longitudinally strong.

Pivot joint 38 is configured so that when the elongate shaft 30 is in the fully extended position shown in FIG. 1 with gate 12 closed—that is, when the entire shaft is linear—there is a spring force applied to both sections of shaft 30, namely, both proximate and distal arms 32 and 34, that tends to drive the elongate shaft toward the flexed or elbowed position. Similarly, when the gate 12 is in the fully open position and elongate shaft 30 is angularly flexed to the maximum amount at pivot joint 38, as shown in the dashed lines in FIG. 1 and the solid lines in FIG. 3, there is a spring force applied to both sections of shaft 30 that tends to drive the elongate shaft toward the linear, non-flexed position. The direction of the spring force applied to the elongate shaft when it is in the liner, non-flexed position is illustrated with arrow C in FIG. 2. The direction of the spring force applied to the shaft when it is in the fully flexed position is illustrated with arrow D in FIG. 1.

With reference to FIG. 4, the interior of first body portion 50 of pivot joint 38—that is, the side of the first body portion that mates with second body portion 52 when the two body portions are attached to one another with bolt 60, includes a machined or hollowed, generally V-shaped cavity 78 that has a pin 80 at the apex of the V. An helical torsion spring 82 is received in cavity 78 with pin 80 extending through the helical portion of the spring and the spring's first leg 84 retained in a first leg section 88 of the V-shaped cavity 78, and the spring's second leg 86 retained in a second leg section 90 of the cavity. The spring 82 is configured so that the spring pressure is applied from legs 84 and 86 in the outwardly directed direction—that is, arrows A and B in FIG. 4.

The interior of first body portion 50 also includes a semi-circular cavity 92 that extends approximately 180° around the periphery of the body portion around the apex of the V-shaped cavity 78. The cavity 92 opens at its opposite ends into the two leg sections 88 and 90 of cavity 78—the two openings are identified with reference numbers 94 and 96, respectively. As best shown in FIG. 4, first leg 84 of spring 82 extends past opening 94, and second leg 86 of the spring extends past opening 96.

The interior of second body portion 52 of pivot joint 38—that is, the side of the second body portion that faces and mates with first body portion 50 when the two body portions are attached to one another with bolt 60, has three pins 100, 102 and 104 fixedly attached to the second body portion and extending in the downward direction toward the first body portion and which are arranged in a generally triangular configuration, with pin 100 defining the apex of the triangle and pins 102 and 104 defining the other points of the triangle. When the first and second body portions 50 and 52 are assemble together with bolt 60, the three pins 100, 102 and 104 are received into the semi-circular cavity 92. As noted earlier, second body portion 52 may be axially rotated relative to first body portion 50 around the axis defined by bolt 60. Thus, as shaft 34 moves, second body portion 52 rotates about bolt 60, and pins 100, 102 and 104 move in a semi-circular path in semi-circular cavity 92.

Reference is now made to FIG. 6 to detail how pivot joint 38 operates. When elongate shaft 30 is in the fully linear position—that is, the shaft is straight and there is an angle of around 180° between arms 32 and 34, pin 104 has passed through opening 94 and is bearing against leg 84 of spring 82, compressing the spring and causing spring forced to be applied through pin 104 and its connection to body portion 52 to arms 32 and 34, urging the arms to move relative to one another at the pivot joint such that the arms are pushed in the direction toward the flexed position. This position is shown with solid lines in FIG. 6. When the shaft 30 is straight, leg 84 of spring 82 defines a stop for arm 32. However, the stop is a cushioned stop since the leg of the spring does not abut the interior wall 106 of cavity 88. As such, not only is the elongate shaft 30 normally urged toward the flexing position when the gate 12 is fully closed and shaft 30 is linear, but the counter-rotating spring force applied to the gate arms 32 and 34 helps maintain the gate in a firmly closed position and provides a cushioning action when the gate reaches its fully closed position. This helps prevent the gate from rattling.

With continued reference to FIG. 6, movement of the gate arms 32 and 34 relative to one another at pivot joint 38 is illustrated for convenience by showing movement of arm 34 with arm 32 being shown as stationary. Movement of the arm 34 in the clockwise direction represents movement of the arm when the gate moves from the closed toward the open position. When arms 32 and 34 are linear, as shown with the solid lines, pin 104 is being pushed by leg 84 of spring 82, with the resultant force being applied on the arms 32 and 34 in the direction of arrow C. As arm 34 moves in the clockwise direction in FIG. 6, beginning with the arm shown in solid lines where arm 34 is aligned with arm 32 so that the entire elongate shaft 30 is linear, spring force applied by leg 84 to pin 104 is maintained through an arc of rotation of about 30°. This is shown as angle $Ø_1$ in FIG. 6. Once the arm 34 has rotated past about 30°, the spring force ceases because movement of leg 84 of the spring is stopped when the leg abuts the interior wall 108 of cavity 88, opposite interior wall 104. Pin 104 passes through opening 94, and once the pin clears the opening, shaft freely rotates through an arc of rotation of about 120°, shown in FIG. 6 as angle β. At this point, pin 102 passes through opening 96 and makes contact with leg 86 of spring 82, causing the spring to compress and thus slowing the movement of the gate as it is moving toward the open position, and cushioning the gate as it stops in the fully open position. When the gate is in the fully open position, arm 34 is located at an angle of about 30° relative to the linear axis of the elongate shaft 30, referenced with angle $Ø_2$ in FIG. 6.

Figure 7:
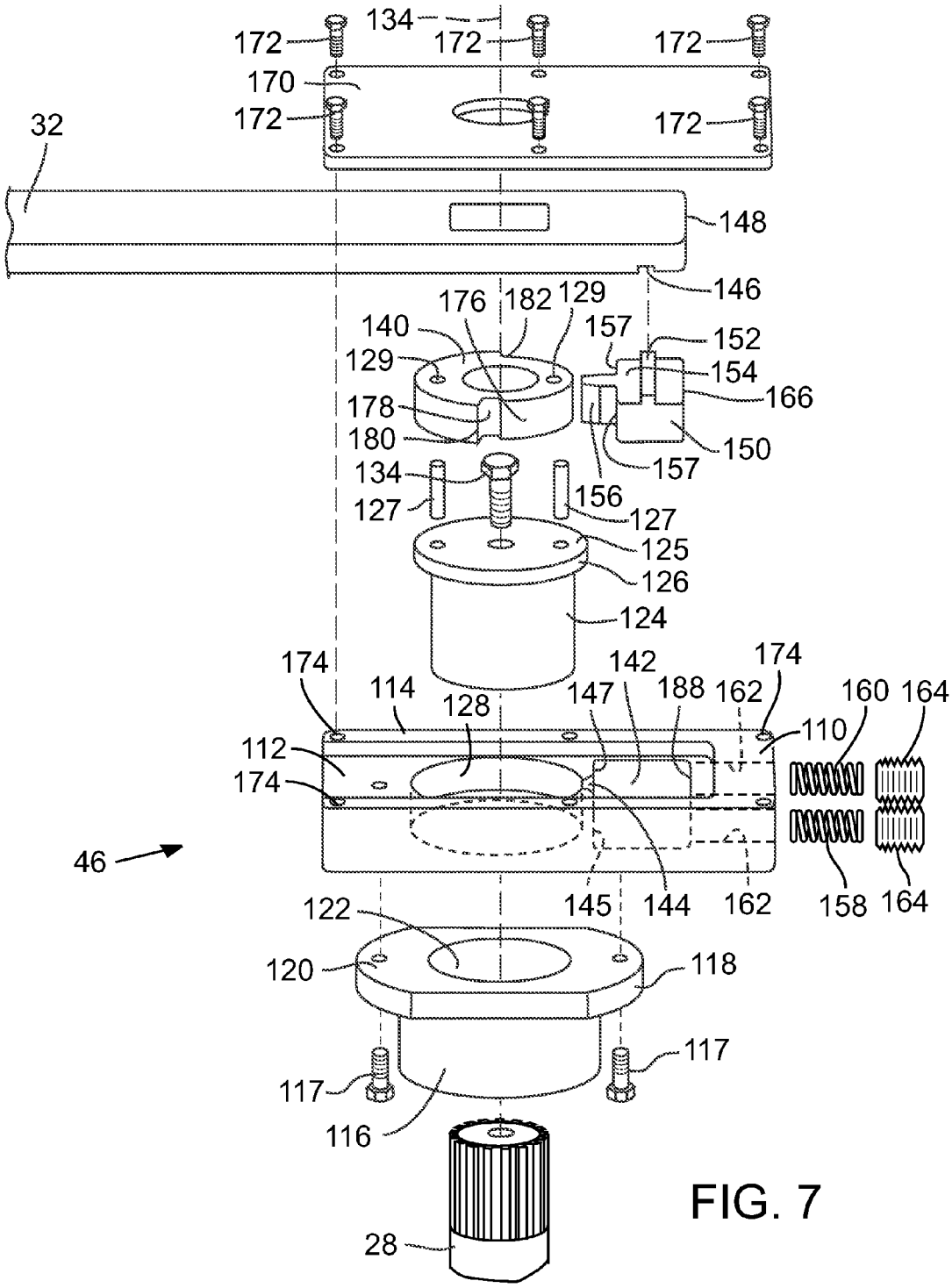
FIG. 7 is an exploded view showing the automatic release mechanism according to the present invention in isolation.
Figure 8:
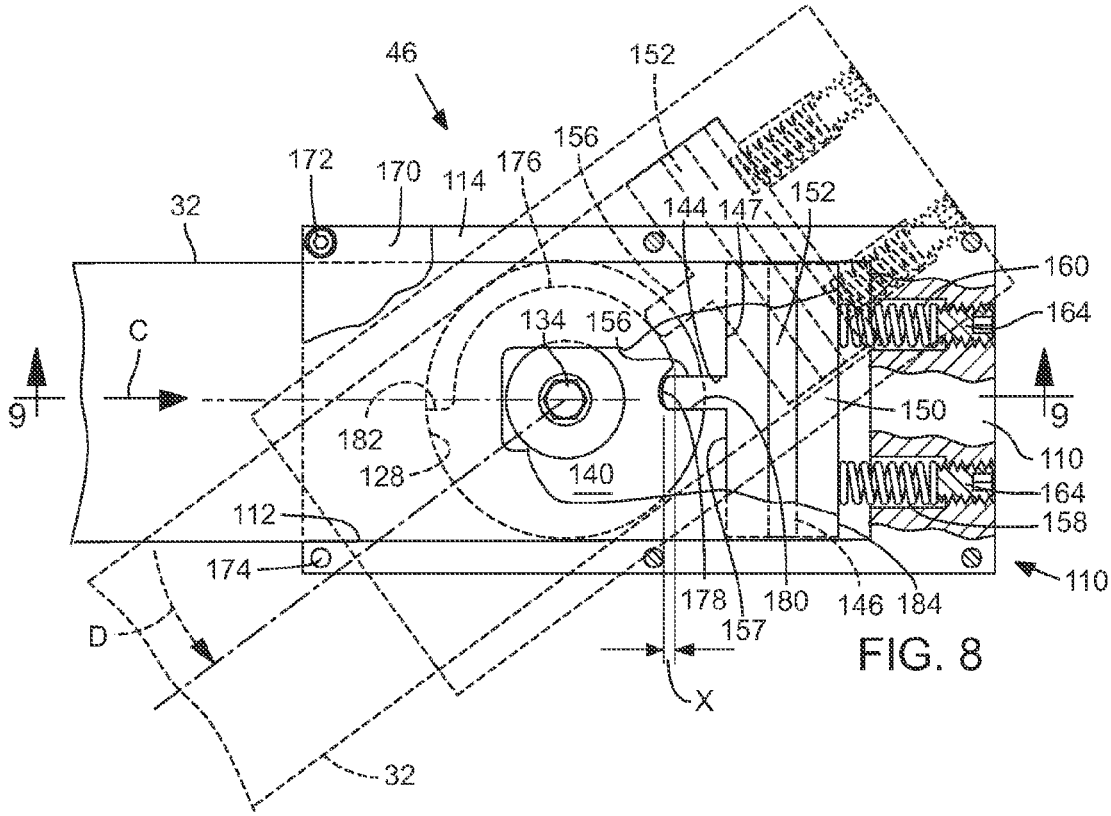
FIG. 8 is a partial sectional view of the automatic release mechanism according to the present invention, illustrating the internal components of the mechanism and showing the mechanism in a locked position in solid lines, and in a released position in dashed lines.
Figure 9:
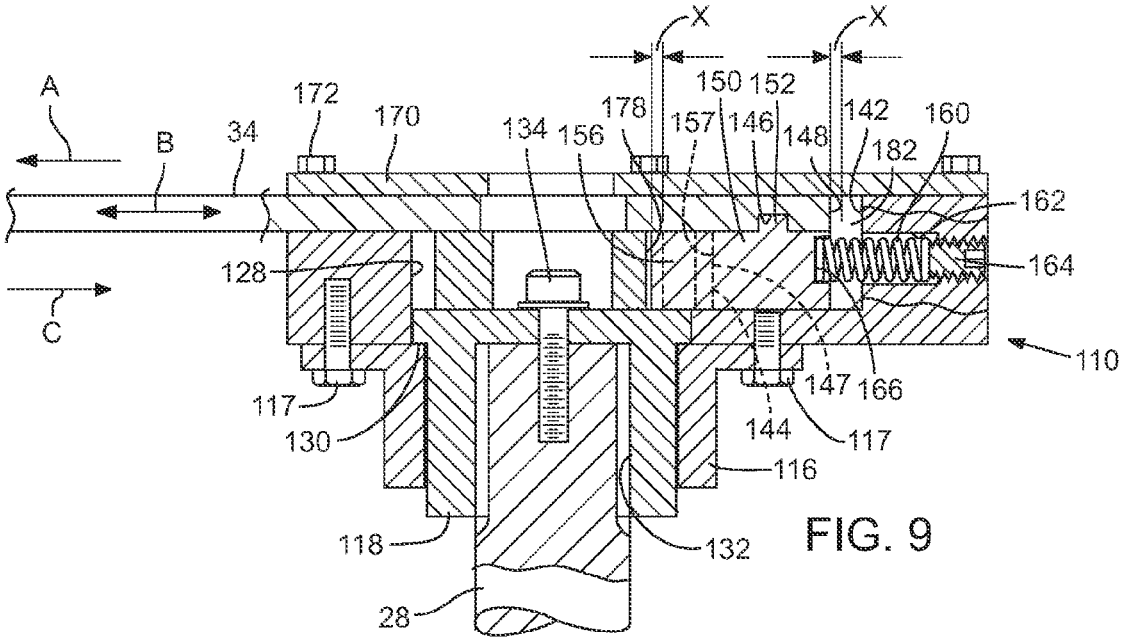
FIG. 9 is a cross sectional view of the automatic release mechanism shown in FIG. 7, taken along the line 9-9 of FIG. 8.

The release mechanism 46 is shown in isolation and in detail in FIGS. 7, 8 and 9. The release mechanism provides the interconnection between drive shaft 28 of operator 26, and proximate gate arm 32 of the elongate shaft 30. The release mechanism has a rectangular main housing 110 that has a recessed upper area 112 defined and surrounded on three sides by a peripherally extending wall 114, and into which arm 32 is received when assembled. As detailed below, the release mechanism 46 is normally coupled to drive shaft 28 of operator 26 so that rotation of the drive shaft results in rotation of the release mechanism and the attached elongate shaft 30. However, when the release mechanism is in a release position (as when the gate is forced toward the open position when the operator is not running), the gate arm 32 decouples from the drive shaft and this allows the gate arm to rotate freely relative to the drive shaft.

An outer hub 116 has a peripheral flange 118 that has a flattened upper surface 120 that defines a seat onto which main housing 110 is received in the assembled unit. The hub is fixed to the main housing in any appropriate manner, such as with bolts 117, which extend through bores 119 in the flange 118 and thread into threaded openings 121 in the main housing (see FIG. 9). The outer hub 116 has a cylindrically open core 122 into which an inner hub 124 fits such that the inner hub may be rotated relative to the outer hub. Inner hub 124 has an upper peripheral flange 126 that defines an oversized lip. Inner hub 124 fits into the open core 122 of the outer hub with lip 126 resting on the upper surface 120 of the outer hub. The interior of inner hub 124 is configured to receive the drive shaft and to lock to the drive shaft so that whenever the drive shaft rotates, inner hub 124 also rotates. There are numerous configurations for drive shafts 28, and therefore numerous manners in which the inner hub 124 is fixed to the drive shaft. In the illustrated embodiment, shaft 28 defines a male spline and the interior of hub defines a female spline into which the shaft is received (FIG. 9).

A cog or latch block 140 is fixed to the upper surface 125 of inner hub 126. The latch block may be attached to the hub in any appropriate manner, even permanently as by welding, or the hub and cog may be formed in a single piece, but for reasons detailed below, it is preferred that the latch block is removably attached to the hub. In the illustrated embodiment a pair of pins 127 extend from opposite sides of surface 125. The pins 127 are received into bores 129 formed in latch block 140. After the outer hub 116 has been bolted to main housing 110, and latch block 140 is fixed to the upper surface 125 of inner hub 124, the inner hub is inserted into opening 122 of the outer hub and the combined hubs and main housing is attached to the drive shaft 28. The drive shaft 28 is inserted into the opening interior 132 of inner hub 124 with the male and female splines mating with one another. A bolt 134, as best shown in FIG. 9 is used to attach the inner hub 125 to the drive shaft 28.

Main housing 110 has a first cylindrical opening 128 into which latch block 140 is received and in which the latch block may rotate. Main housing 110 has a second rectangular opening 142 that communicates with cylindrical opening 128 through a passageway 144 that is bordered by opposed walls 145 and 147. Internal opening 142 is configured for receiving a catch pin 150 that is fixed to arm 32. More specifically, a slot 146 is formed in the proximate end 148 of shaft 34; the slot 146 is transverse to the longitudinal axis of the shaft. A ridge 152 extends across the upper surface 154 of catch pin 150 and the ridge fits into the slot to thereby fix the catch pin to the shaft. The catch pin may be fixed to the shaft in other equivalent manners, for example with a bolt, by welding, etc. The forward end of catch pin 150 has a tooth 156 that defines a pair of shoulders 157 on the catch pin on opposite sides of the tooth 156. A pair of springs 158 and 160 are received in bores 162 formed through the rearward end of main housing 110 (one of the bores 162 is shown in FIG. 9). The bores, which are threaded, define seats for receiving the springs 158 and 160, and set screws 164. When the catch pin 150 is assembled with main housing 110, the springs 158 and 160 are received in the seats defined by bores 162 and are held in place with set screws 164. The opposite (i.e., "forward") ends of the springs are received in blind cavities or seats 167 (see FIG. 9) formed in the facing surface 166 of catch pin 150 and the springs thus bear against the catch pin. Because the catch pin is fixed to arm 32, the springs push the catch pin 150 and the arm 32 in the direction of arrow A in FIG. 9 until shoulders 157 on catch pin 150 abut walls 145 and 147, respectively. In this position, tooth 156 extends through passageway 144 and into opening 128. A cap 170 is bolted to the top of main housing 110 with bolts 172 that thread into threaded openings 174 in peripheral wall 114. Neither the bolts 172 nor the cap 170 makes contact with shaft 34, and therefore the shaft is free to reciprocate in the main housing as detailed below.

Returning now to FIG. 7, latch block 140 includes a peripheral surface 176 that extends approximately 180° around the perimeter of the block. A notch 178 is formed at one end of peripheral surface 176 and a shoulder 180 is formed adjacent the notch 178 to define a stop. A similar shoulder 182 defines a stop at the opposite end of surface 176.

When release mechanism 46 is assembled, tooth 156 of catch pin 150 engages notch 178 of latch block 140 under the force applied to the catch pin by springs 158 and 160. Thus, the tooth 156 extends through passageway 144 into the opening 128, latch block 140 is received in opening 128, and the tooth 156 engages the notch 178. Because the catch pin 150 is fixed to arm 32, the force of the springs 158 and 160 drives the shaft in the direction of arrow A in FIG. 9. As drive shaft 28 is rotated by operation of operator 26, arm 32 is rotated by virtue of its direct connection to the drive shaft through catch pin 150 and tooth 156, which is in engagement with notch 178. Under normal operating conditions, this is the manner in which the gate assembly operates to open and close the gate.

However, as indicated in FIG. 9 with arrow B, shaft 34 can be pushed inwardly into the housing 110, and by virtue of springs 158, 160, may reciprocate in a back and forth direction relative to housing 110. A space 182 is defined between the aligned rear edges 184 of catch pin 150 and shaft 34, and the facing wall 188 of opening 142. This allows shaft 34 to be pushed in the direction of arrow C in FIG. 9 against the spring force of springs 158 and 160, causing the springs to be more compressed from their normal compression. When shaft 34 is pushed in the direction of arrow C (as would occur when an automobile pushes against gate 12 without operating the operator 26), tooth 156 also moves in the same direction and when the shaft and tooth have moved a threshold distance shown in FIG. 9 as distance X, the tooth 156 disengages from notch 178. At this point, tooth 156 is free to travel over peripheral surface 176 of latch block 140. Stated another way, once the tooth 156 has disengaged from the latch block, the main housing 110 is free to rotate with outer hub 116, while the inner hub 124, latch block 140, and drive shaft 28 remain stationary. This allows the gate to swing inwardly, toward the open position even though the drive shaft 28 is not operating.

Recall that in the fully closed position, pivot joint 38 maintains a spring pressure on the two gate arms 32 and 34. If the gate is pushed inwardly by a car or some other force (i.e., direction A' in FIG. 2), the elongate shaft 30 and thus gate arm 32 is pushed in the direction of arrow C in FIG. 9, causing the tooth 156 to disengage from notch 178. When the tooth disengages from the notch, the spring force applied to the gate arms 32 and 34 by pivot joint 38 causes the two arms to flex relative to one another at the pivot joint 38, with the result being that the gate swings open freely as tooth 156 rides over the surface 176.

The release of arm 32 by release mechanism 46 is shown in FIG. 8. The solid lines in this figure represent normal operating conditions, with tooth 156 engaging notch 178. However, when arm 32 is pushed inwardly into the housing 110 (arrow C) by distance X, tooth 156 disengages from notch 178, allowing the arm 32 and housing 110 to swing freely in the direction of arrow D, while the latch block 140 and drive shaft remain stationary. The arm 32 and thus the gate 12 may swing freely until tooth 156 abuts the stop defined by shoulder 182 at the opposite end of peripheral surface 176. However, before the tooth abuts the hard stop defined by shoulder 182, the spring cushioning function of pivot joint 38 described above when the gate is in the fully open position occurs. Thus, the cushioning provided by pin 102 pushing against leg 86 of spring 82 when the gate is approaching fully open slows the movement of the gate before tooth 156 hits shoulder 182. When drive shaft 28 is once again rotated by operator 26 the cog 140 will rotate until notch 178 aligns with tooth 156, at which point the tooth re-engages notch 178 by virtue of springs 158 and 160 urging the tooth through passageway 144, and normal operations may continue. Of course, the released gate may be swung manually back into the closed position, at which point the tooth 156, under spring force applied by springs 158, 160, re-engages the notch.

Based upon the foregoing description of the invention and the drawings of it, those of ordinary skill in the art will readily appreciate that the release mechanism 46 provides means to prevent damage to the gate system, including the gate arms and operator, in the event of undesired force applied to the gate when it is closed. The release mechanism works in cooperation with the pivot joint so that as soon as the gate is pushed past a threshold point at which the tooth 156 of the release mechanism disengages from notch 178, the spring-loaded pivot joint immediately causes the gate arm 30 to flex, which allows the gate to open freely. However, it will be appreciated that the release mechanism will operate without the spring-loaded pivot joint. The release mechanism 46 thus normally operates in a first mode in which the tooth 156 is engaged in notch 178 and the gate moves from closed to open, and from open to closed, only when the operator 26 is turning drive shaft 28. The release mechanism is however operable in a second mode in which tooth 156 had disengaged from notch 178 and the gate is movable without operation of the operator and drive shaft. In this second mode the release mechanism functions as a safety to prevent damage to the components of the gate assembly 5

With returning reference to FIG. 7, when latch block 140 is fixed to inner hub 124 with pins 127 (or when the latch block is otherwise removably attached to the hub), the latch block may be reversed. Some gates are right handed, and some are left handed, the handedness referring to the direction in which the gate opens. By allowing the latch block to be reversed, the release mechanism 46 may be adapted for use with either a right or left handed gate.

It will be appreciated that there are numerous structures that may be used to assemble the main housing with the drive shaft and that the embodiment shown in the drawings is for illustrative purposes; the invention is not limited to the particular structures shown.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A release apparatus for a swing gate, comprising:

a gate arm having a first end attached to the swing gate and in a first position said gate arm defining a linear axis;

an operator comprising a motor connected to a drive shaft and operable for rotating the drive shaft in opposite first and second rotational directions, said drive shaft connected to a second end of said gate arm so that rotation of the drive shaft in the first direction moves the gate arm to thereby move the swing gate between open and closed positions and so that rotation of the drive shaft in the second direction moves the gate arm to thereby move the swing gate between the closed and open positions; and a release mechanism interconnecting the second end of said gate arm to the drive shaft, said release mechanism operable in a first mode in which the gate arm and the swing gate are moved when the drive shaft rotates in either the first or second directions, and a second mode in which the swing gate and the gate arm are movable when the drive shaft is stationary, wherein said release mechanism operates in the second mode when force is applied to the gate arm along the linear axis when the gate arm is in the first position.

2. The release apparatus according to claim 1 in which the release mechanism is normally in the first mode and is moved to the second mode when the swing gate is forced toward the open position from the closed position without simultaneous rotation of the drive shaft, and wherein the second end of said gate arm is connected to the drive shaft when the release mechanism is in both the first and second modes.

3. The release apparatus according to claim 2 wherein the release mechanism further comprises:

a housing;

a cog retained in the housing and directly connected to the drive shaft, said cog having a notch formed therein;

a notch engaging member retained in the housing and attached to the gate arm;

a spring for urging the notch engaging member into engagement with the notch in the cog when the release mechanism is in the first mode.

4. The release apparatus according to claim 3 wherein when the release mechanism is in the first mode and the gate arm is in the first position, and gate arm is movable to a second position in which the notch engaging member disengages from the notch in the cog.

5. The release apparatus according to claim 4 wherein the release mechanism is in the second mode when the gate arm is in the second position and said gate arm defines a linear axis.

6. The release apparatus according to claim 1 wherein the gate arm further comprises a first arm section attached to the release mechanism, a second arm section attached to the swing gate, and a pivot joint interconnecting the first and second arm sections.

7. The release apparatus according to claim 6 wherein the gate arm is in the first position when the swing gate is in the closed position and in a flexed position when the swing gate is in the open position such that said gate arm is bent at said pivot joint, and wherein when the gate arm is in the first position, the pivot joint applies spring pressure to the gate arm, urging said gate arm toward the flexed position.

8. The release mechanism according to claim 7 wherein when the gate arm is in the flexed position the pivot joint applies spring pressure to the gate arm, urging said gate arm toward the first position.

9. The release mechanism according to claim 6 in which the pivot joint comprises a housing having first and second body portions that are rotatable relative to one another, the first body portion attached to the first arm section and the second body portion attached to the second arm portion, and a spring contained in the housing.

10. In a swing gate assembly having a swing gate movable between closed and open positions, and a gate arm connecting the swing gate to an operator, said gate arm defining a substantially linear member having a longitudinal axis when said swing gate is in the closed position, the improvement comprising:

said operator comprising a motor having a drive shaft and said motor operable to rotate the drive shaft in opposite rotational directions, said drive shaft engaging said gate arm and wherein rotation of the drive shaft in a first rotational direction causes the swing gate to move from the closed to the open position and rotation of the drive shaft in a second rotational direction causes the swing gate to move from the open to the closed position;

gate arm release means connecting the gate arm to the drive shaft and for releasing the connection between the gate arm and the drive shaft when pressure is applied to the swing gate along the longitudinal axis when said swing gate is in the closed position and the drive shaft is not rotating in either the first or second directions, so that when the gate arm is released from the drive shaft the swing gate is freely movable from the closed position toward the open position without rotation of the drive shaft.

11. The swing gate assembly according to claim 10 wherein the gate arm release means is operable in a first mode in which the gate arm and swing gate are moved when the drive shaft is rotating in either the first or second rotational directions, and a second mode in which the gate arm and swing gate are movable when the drive shaft is not rotating, and wherein the gate arm is connected to the drive shaft when the gate arm release means is in both the first and second modes.

12. The swing gate assembly according to claim 11 wherein the release mechanism further comprises a housing, a latch block retained in the housing and directly connected to the drive shaft, a latch member retained in the housing, and a spring for urging the latch member into engagement with the latch block when the release mechanism is in the first mode.

13. The swing gate assembly according to claim 10 wherein the gate arm comprises a first arm section having a first end attached to the gate arm release means and a second arm section having a first end attached to the swing gate, and including spring joint means interconnecting respective second ends of the first and second arm sections for urging the gate arm toward a position in which said gate arm is pivoted about said spring joint means when the gate arm is in the closed position.

14. The swing gate assembly according to claim 13 wherein the spring joint means comprises a housing having first and second body portions that are rotatable relative to one another, the first body portion attached to the first gate arm section and the second body portion attached to the second gate arm portion.

15. The swing gate assembly according to claim 14 including a spring retained in the housing and operable to apply spring force to the gate arm when the gate arm is in the closed position, and when the gate arm is in an open position.

16. A release apparatus for a swing gate, comprising:

a two-piece gate arm having a first end of the first piece attached to the swing gate and a first end of the second piece connected to a drive shaft, said gate arm having a pivotable joint interconnecting the second end of the first piece of said gate arm to the second end of the second piece of said gate arm so that the gate arm is movable about said pivotable joint between a first gate arm position in which said gate arm defines a linear elongate member and in a second gate arm position in which said gate arm is bent at the pivotable joint to define a non-linear member;

a motor connected to the drive shaft and operable for rotating the drive shaft in first and second rotational directions, wherein rotation of the drive shaft in the first rotational direction moves the gate arm to move the swing gate between the open and closed positions by moving the gate arm between the second gate arm position and the first gate arm position, and wherein rotation of the drive shaft in the second rotational direction moves the gate arm to move the swing gate between the closed and open positions by moving the gate arm from the second gate arm position to the first gate arm position;

a release attached to both the drive shaft and the gate arm and engaging the drive shaft with the gate arm, said release comprising a housing with a cog therein, said housing directly connected to the drive shaft so that rotation of the drive shaft rotates the housing, said cog having a notch formed therein, a notch engaging member in the housing and attached to the gate arm, and a spring for urging the notch engaging member into engagement with the notch in the cog when said release is in a first release position;

said release normally in the first release position in which said drive shaft is directly engaged with said gate arm so that rotation of the drive shaft in the first rotational direction causes the swing gate to move between the open and closed positions, and wherein rotation of the drive shaft in the second rotational direction causes the swing gate to move between the closed and open positions; and said release movable to a second release position in which said drive shaft is released from its engagement with said gate arm and said gate arm remains connected to said drive shaft.

17. The release apparatus according to claim 16 wherein when said release is in said second release position said notch engaging member is disengaged from said notch.

18. The release apparatus according to claim 17 wherein when said release is in said second release position rotation of said drive shaft does not cause said swing gate to move.

19. The release apparatus according to claim 16 wherein said gate arm pivotable joint comprises a spring that normally urges said gate arm under spring force toward the first gate arm position.

20. The release apparatus according to claim 19 wherein the gate arm pivotable joint comprises a body member interconnecting the second end of the first piece of said gate arm to the second end of the second piece of said gate arm, said body member having a V-shaped internal cavity housing said spring, said spring comprising a V-shaped member with a first leg and a second leg, and wherein when said release is in the first release position said first and second legs of said spring urge said gate arm toward the first gate arm position.

* * * * *